United States Patent [19]

Lieberman

[11] 4,148,111

[45] Apr. 10, 1979

[54] TEMPERATURE COMPENSATING HYDRAULIC DOOR CLOSER

[75] Inventor: Sideny Lieberman, Lancaster, Pa.

[73] Assignee: Reading Door Closer Corp., Reamstown, Pa.

[21] Appl. No.: 856,133

[22] Filed: Nov. 30, 1977

[51] Int. Cl.[2] ..... E05F 3/04

[52] U.S. Cl. ..... 16/59; 16/84

[58] Field of Search ..... 16/49, 51, 52, 56, 59, 16/66, 82, 84; 49/137; 292/341.2; 188/297; 137/468

[56] References Cited

U.S. PATENT DOCUMENTS

| | | | |
|---|---|---|---|
| 2,021,427 | 11/1935 | Peo | 137/468 |
| 2,192,745 | 3/1940 | Hurd | 16/56 |
| 2,909,248 | 10/1959 | Gies | 137/468 X |
| 2,966,170 | 12/1960 | Raulins | 137/468 |
| 3,340,893 | 9/1967 | Lockwood | 137/468 |
| 3,574,886 | 4/1971 | Solovieff | 16/51 |
| 4,019,220 | 4/1977 | Lieberman | 16/59 |

*Primary Examiner*—Ronald Feldbaum
*Attorney, Agent, or Firm*—Robert C. Podwil

[57] ABSTRACT

Hydraulic door closer apparatus comprises a cylinder, a piston disposed in the cylinder, linkage means coupled to the piston for transmitting forces between the piston and a door, and a hydraulic circuit for controlling movement of the piston in the cylinder. A temprature responsive control element is provided in the hydraulic circuit to alter the characteristics of the circuit in response to changes in ambient temperature or temperature of the fluid within the closer.

3 Claims, 4 Drawing Figures

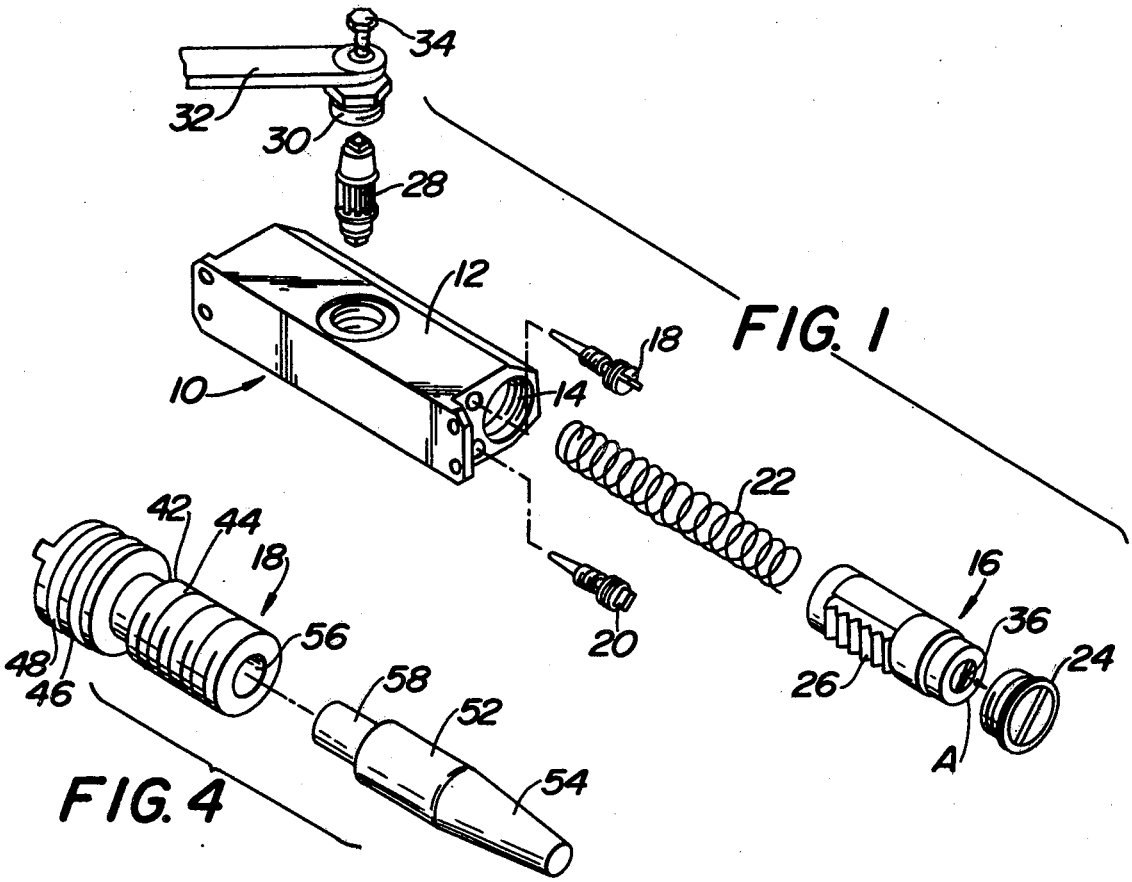
FIG. 1
FIG. 4
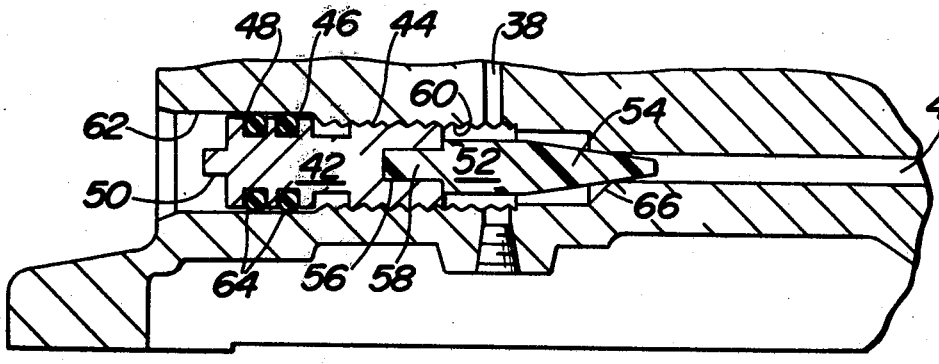
FIG. 2
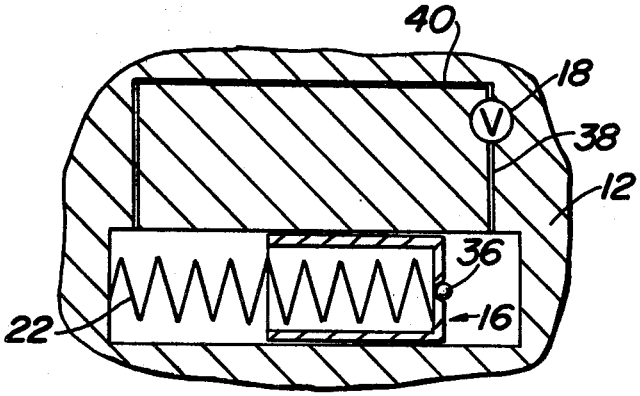
FIG. 3

TEMPERATURE COMPENSATING HYDRAULIC DOOR CLOSER

BACKGROUND OF THE INVENTION

This invention relates to hydraulic door closer apparatus, and more particularly, to hydraulic door closer apparatus having temperature compensating features. In general, this invention relates to the general type of hydraulic door closer illustrated in U.S. Pat. No. 2,192,745, issued Mar. 5, 1940, to Hurd, in which a spring-urged hydraulic piston is arranged to bias a door to its closed position with appropriate hydraulic damping. Typically, in the use of apparatus of this sort, the force generated by a spring is transmitted between the door closer and, depending upon where the closer is mounted, either the door or door frame. For this purpose, it is conventional to provide a linkage consisting of a pair of links, coupled to the unit and to the door or door frame, as the case may be. In the Hurd patent to which reference is made above, a rack and pinion arrangement is used to convert the linear movement of the piston within the device to rotary motion of the linkage.

Upon opening of the door, the piston is driven by the pinion against the bias of a return spring and against fluid resistance provided by hydraulic circuitry within the device. The hydraulic circuitry can be adjusted to provide for variable cushioning or "back-check" effect as the door approaches the limits of its swing toward the open position. The movement of the door toward the closed position is accomplished by unloading of the return spring, the speed of closing being controlled by appropriate damping by the hydraulic circuitry.

The effect of temperature on the viscosity of oil and oil-based fluids such as hydraulic fluids is well-known. Typically, subjecting a hydraulic fluid to a decrease in temperature results in an increase in its viscosity, denoting a relative "stiffening" of the fluid to resist flow. In the context of door closer operation, this means that if a closer and its fluid are subjected to a reduction in operating temperature, movement of the piston will become more difficult, and hence, slower, reflecting the heightened resistance of the fluid to flow. In the extreme case, the closer might not work at all. At the other extreme, increased working temperature might cause sufficient "thinning" of the fluid to reduce or eliminate the damping effect of the closer. The closer may then close so abruptly as to result in damage to the door, door frame, or the closer itself.

For door closer installations which are subject to wide swings in temperature, such as for example, exterior doors subjected to seasonal changes in temperature, variations in ambient temperature can significantly affect the performance of the closer. Although closers are typically provided with manually adjustable means for selectively regulating fluid flow, it is inconvenient and impractical to continually manually adjust the closer to compensate for temperature changes.

It is, therefore, a principal object of this invention to provide a door closer in which temperature-compensating features are provided, so that wide swings in ambient temperature are automatically compensated for and the operating characteristics of the closer remain reasonably constant over a wide range of ambient temperatures.

Frequent door openings create friction which raises the oil temperature inside the closer. It is another general object of this invention to provide a door closer suitable for use in applications in which the closer itself is subjected to wide internal temperature swings.

The foregoing and other objects of this invention are realized, in a presently preferred form of the invention, by a door closer which has a housing containing a cylinder, a piston disposed in the cylinder, a linkage coupled to the piston for transmitting forces to and from the piston, and a hydraulic circuit for controlling movement of the piston in the cylinder. The hydraulic circuit in accordance with the invention is provided with one or more adjustable valve members each made up of multiple materials having different thermal properties, namely, a first portion of relatively dimensionally stable structural material, and a second portion made of a material whose dimensions are relatively highly responsive to temperature changes in the range of changes to which the closer is likely to be subjected. The second portion of the valve member is so designed and so disposed in operation that changes in the temperature to which it is subjected affect clearance between the second portion and a valve seat with which the valve member is associated. In effect, the dimensional changes in the second portion of the valve member induced by changes in temperature serve to restrict or enlarge a flow passage, thus altering the fluid resistance produced by the closer.

For the purpose of illustrating the invention, there is shown in the drawings a form of the invention which is presently preferred, it being understood, however, that the invention is not limited to the precise arrangement and instrumentalities shown.

FIG. 1 is an exploded view, in perspective, showing the general arrangement of a door closer in accordance with the present invention.

FIG. 2 is a partial cross-sectional view of the housing portion of the door closer shown in FIG. 1, showing part of the hydraulic circuit, and also showing in cross section a valve member in accordance with the present invention.

FIG. 3 is a simplified schematic drawing of the hydraulic circuit of a door closer with the present invention.

FIG. 4 is an exploded view of a valve member in accordance with the invention.

Referring now to the drawings in detail, wherein like numerals indicate like elements, there is seen in FIG. 1 hydraulic door closer apparatus designated generally by the reference numeral 10. The apparatus 10 is of the general type described in U.S. Pat. No. 4,019,220 issued Apr. 26, 1977 to Sidney Lieberman, and assigned to the assignee of the present application.

Thus, the door closer apparatus 10 includes a case or housing 12, provided with a bore 14, into which is received a piston designated generally by the reference numeral 16.

The housing 12 will be understood by those skilled in the art to have within it suitable fluid passages. Adjustable valves 18 and 20 are associated with the passages, and control fluid flow within them to determine the speed of action of the door closer apparatus 10 and, if need be, to lock the door closer apparatus 10.

Received within the bore 14 is a return spring or springs 22 for the previously mentioned piston 16. An end cap 24 serves to retain fluid within the housing 12.

It will thus be understood that the piston 16 is reciprocable within the bore 14, and that the bore 14 is ordinarily filled with fluid. A rack 26 associated with the piston 16 engages a pinion 28 rotatably mounted by means of suitable bearings and bearing housings, such as the bearing housing 30 shown in FIG. 1, in the housing 12. A control arm 32 is affixed to the pinion 28 as, for example, by means of the shaft screw 34, to carry rotary motion of the pinion 28 through the housing 12. A suitable linkage, which includes the control arm 32, thus cooperates with the pinion 28 to transmit motion of the piston 16 to the linkage and a door.

The piston 16 is provided with a ball-valve 36 which permits selective fluid flow through the piston 16 when the piston moves toward the left in FIG. 1, but not when the piston moves toward the right. Movement of the piston 16 toward the left in FIG. 1 represents or corresponds to the opening of a door associated with the door closer apparatus 10, and movement toward the right represents or corresponds movement of the door toward a closed position. In operation, then, opening of the door, not shown, with which the door closer apparatus 10 is associated, causes movement of the control arm 32 and rotation of the pinion 28, which, in turn, causes the piston 16 to traverse the bore 14 of the housing 12 toward the left in FIG. 1. Such movement opens ball-valve 36 to permit relatively free flow of fluid in the direction depicted by the arrow "A" in FIG. 1, and results in compression of the return spring 22. Upon release of the door, the bias of the return spring 22 urges the piston 16 toward the right in FIG. 1, and the linear movement of the piston 16 causes in turn rotation of the pinion 28 and movement of the control arm 32 to bias the door to a closed position.

Referring now to FIG. 3, it will be seen that movement of the piston 16 under the urging of return spring 22 is damped or retarded by movement of fluid in a circuit comprising return passages 38 and 40. Movement of the piston 16 to the right in FIGS. 1 and 3 causes closing of the ball-valve 36 and the movement of fluid through the return passages 38 and 40 to the opposite side of the piston 16. Fluid resistance in the return passages 38 and 40 provides the desired retarding or damping effect.

The valve member 18, which will now be described in detail, provides a variable fluid resistance in the return passage 38 and 40.

Referring now to FIGS. 2 and 4, the valve member 18 is seen to comprise a first portion 42 having screw threads 44 and a pair of axially spaced peripheral grooves 46 and 48. Also provided on the first portion 42 is suitable means, such as a blade 50 or a slot to facilitate adjustment of the valve member 18 by rotation of the first portion 42.

The valve member 18 also includes a second portion 52, which, in the illustrated embodiment, includes a tapered nose section 54. Also in the illustrated embodiment the first portion 42 includes an axially extending bore 56 and the second portion 52 includes an axially extending projection 58. The bore 56 and projection 58 are so dimensioned that the projection 58 is adapted to be received in the bore 56 with an interference fit.

The case or housing is provided with a threaded bore 60 complemental with the screw threads 44 of the first portion 42 of the valve member 18. Coaxial with the bore 60 is a smooth-finished bore 62 which is juxtaposed to the peripheral grooves 46 and 48 of the valve member 18 when the valve is operatively disposed. A pair of O-rings 64 are received in the peripheral grooves 46 and 48 and bear against the bore 62 to provide a fluid-tight seal between the valve member 18 and the housing 12. The tapered nose section 54 of the second portion 52 of the valve member 18 projects into juxtaposition with a valve seat 66 in the housing 12 and in fluid communication with the return passages 38 and 40.

It will now be seen that movement of the tapered nose section 54 with respect to the valve seat 66 serves to open or constrict the cross sectional area available for fluid flow through the return passages 38 and 40. Such movement of the tapered nose section 54 may be achieved for the purpose of adjustment by action of the screw threads 44 upon rotation of the valve member 18. Such movement may also occur, however, as a result of temperature changes, in the manner which will be described.

The first portion 42 is made of a relatively dimensionally stable structural material having suitable mechanical properties. For example, the first portion 42 may be made, as in one presently preferred embodiment, of steel 12L14, having a coefficient linear expansion, at 68° F. (20° C.) of $6.3\times10^{-6}$ in./in./° F.* Another possible material for the first portion 42, although somewhat less desirable due to its thermal and other mechanical properties, would be aluminum, having a coefficient of linear expansion of $1.2\times10^{-5}$ at 68° F.

*All coefficients of linear expansion stated herein are in "inches per inch per degree F."

The second portion 52 of the valve member 18 is made of a material having a substantially greater coefficient of linear expansion than the material of the first portion 42.

A presently preferred material for the second portion 52 is the plastic polymeric material sold under the trademark "Delrin", which has a coefficient of linear expansion of $5.8\times10^{-5}$ in the temperature range of −40° F. to 85° F. (−40° C. to 29.5° C.) and $6.8\times10^{-5}$ in the temperature range 86° F. to 140° F. (30° C. to 60° C.). The above-mentioned material has been found to have desirable structural properties, including strength and toughness, in addition to suitable thermal properties. Other suitable materials might be used, however, among them Nos. 66 Nylon, 612 Nylon, Minlon No. 10B40, and Lucite acrylic.

It will be recognized that the temperature changes which cause the above-mentioned dimensional changes in the second portion 52 also have the effect of changing the viscosity of the fluid within the housing 12. On the one hand, the viscosity decreases with increases in temperature, and on the other, it increases with decreases in temperature. Thus, for example, in a door closer 10 in accordance with the present invention, mounted so as to be subject to seasonal temperature changes of perhaps 100° F. (56° C.), an increase in temperature resulting in decreased damping effect would be compensated for by expansion of the second portion 52 of the valve 18 so as to limit fluid flow and increase the fluid resistance of the hydraulic circuit. Thus the effect of the temperature change is, at least, in substantial part, compensated for. Decreases in temperature are compensated for in an opposite manner, the tendency of the hydraulic fluid to become sluggish when cold being compensated for by a contraction of the second portion 52, with attendant decrease in the fluid resistance for a given setting of the valve 18.

The present invention may be embodied in other specific forms without departing from its spirit or essential attributes, and, accordingly, reference should be made to the appended claims rather than the foregoing specification, as indicating the scope of the invention.

I claim:

1. Hydraulic door closer apparatus comprising a housing having a cylinder therein, a piston disposed in said cylinder, linkage means operatively coupled to said piston for transmitting forces to and from said piston and between said piston and door, hydraulic circuit means in said housing for controlling movement of said piston in said cylinder, and hydraulic fluid control means comprising a valve seat and a valve member operatively associated with said valve seat and movably mounted with respect thereto, said valve member comprising a first portion of relatively dimensionally stable material and having means thereon for adjustably coupling said valve member to said housing for movement with respect to said valve seat, and a second portion of material of greater cofficient of thermal expansion than said first portion, said second portion being coupled to the first portion in axial alignment therewith and juxtaposed to said valve seat when said valve member is operatively disposed so that changes in the temperature of said second position affect clearance between said second portion and the valve seat, said first portion of said valve member being made of metal, and said second portion of said valve member is made of plastic polymeric material, and means coupling said second portion of said valve member to said first portion, comprising an axially extending bore and an axially extending projection adapted to be received in said bore, and said projection being interference fitted within said bore.

2. Apparatus in accordance with claim 1, wherein said means for adjustably coupling said valve member to said housing includes a first generally cylindrical element having screw threads thereon, a second generally cylindrical element in axial alignment with said first element, and means on said second element for effecting a fluid seal between said valve member and said housing when said valve member is operatively disposed.

3. Apparatus in accordance with claim 1, wherein said first portion is made of carbon steel, and said second portion is made of material selected from the group consisting of: Delrin, No. 66 Nylon, 612 Nylon, Minlon No. 10B40, and Lucite acrylic.

* * * * *

UNITED STATES PATENT AND TRADEMARK OFFICE

CERTIFICATE OF CORRECTION

PATENT NO. : 4,148,111

DATED : April 10, 1979

INVENTOR(S) : Sidney Lieberman

It is certified that error appears in the above-identified patent and that said Letters Patent are hereby corrected as shown below:

On the title page, item [75] the name of inventor, "Sideny Lieberman" should read -- Sidney Lieberman --.

Signed and Sealed this

*Seventeenth* . Day of *July 1979*

[SEAL]

*Attest:*

LUTRELLE F. PARKER

*Attesting Officer* *Acting Commissioner of Patents and Trademarks*